US010563295B2

(12) United States Patent
Mino

(10) Patent No.: US 10,563,295 B2
(45) **Date of Patent: *Feb. 18, 2020**

(54) METHOD FOR PRODUCING R-T-B SINTERED MAGNET

(71) Applicant: HITACHI METALS, LTD., Minato-ku, Tokyo (JP)

(72) Inventor: Shuji Mino, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 362 days.

This patent is subject to a terminal disclaimer.

(21) Appl. No.: 15/304,886

(22) PCT Filed: Apr. 23, 2015

(86) PCT No.: PCT/JP2015/062348

§ 371 (c)(1),
(2) Date: Oct. 18, 2016

(87) PCT Pub. No.: WO2015/163397

PCT Pub. Date: Oct. 29, 2015

(65) Prior Publication Data

US 2017/0183765 A1 Jun. 29, 2017

(30) Foreign Application Priority Data

Apr. 25, 2014 (JP) ..... 2014-090929
Jun. 30, 2014 (JP) ..... 2014-133621

(51) Int. Cl.
*H01F 41/02* (2006.01)
*H01F 1/057* (2006.01)
(Continued)

(52) U.S. Cl.
CPC ..... *C23C 8/72* (2013.01); *B22F 1/00* (2013.01); *B22F 1/0003* (2013.01); *B22F 3/00* (2013.01);
(Continued)

(58) Field of Classification Search
None
See application file for complete search history.

(56) References Cited

U.S. PATENT DOCUMENTS

2007/0240789 A1* 10/2007 Nakamura ..... H01F 41/0293 148/101
2009/0226339 A1 9/2009 Nakamura et al.
(Continued)

FOREIGN PATENT DOCUMENTS

JP 2007-287874 A 11/2007
JP 2007-287875 A 11/2007
(Continued)

*Primary Examiner* — Xiaowei Su
(74) *Attorney, Agent, or Firm* — Keating & Bennett, LLP

(57) ABSTRACT

A step is provided which performs a heat treatment at the sintering temperature of a sintered R-T-B based magnet or lower, while a powder of an RLM alloy (where RL is Nd and/or Pr; M is one or more selected from among Cu, Fe, Ga, Co and Ni) and a powder of an RH fluoride (where RH is Dy and/or Tb) are present on a surface of the sintered R-T-B based magnet. The RLM alloy contains RL in an amount of 50 at % or more, and a melting point of the RLM alloy is equal to or less than a temperature of the heat treatment. The heat treatment is performed while the RLM alloy powder and the RH fluoride powder are present on the surface of the sintered R-T-B based magnet at a mass ratio of RLM alloy:RH fluoride=96:4 to 5:5.

5 Claims, 4 Drawing Sheets

(51) Int. Cl.

| | |
|---|---|
| ***B22F 3/10*** | (2006.01) |
| ***B22F 3/26*** | (2006.01) |
| ***C23C 8/72*** | (2006.01) |
| ***B22F 3/24*** | (2006.01) |
| ***C22C 28/00*** | (2006.01) |
| ***B22F 1/00*** | (2006.01) |
| ***B22F 3/00*** | (2006.01) |
| ***C22C 33/02*** | (2006.01) |
| ***B22F 3/12*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |

(52) U.S. Cl.

CPC ..... *B22F 3/12* (2013.01); *B22F 3/24* (2013.01); *C22C 28/00* (2013.01); *C22C 33/02* (2013.01); *C22C 38/001* (2013.01); *C22C 38/002* (2013.01); *C22C 38/005* (2013.01); *C22C 38/06* (2013.01); *C22C 38/10* (2013.01); *C22C 38/16* (2013.01); *H01F 1/0577* (2013.01); *H01F 41/0266* (2013.01); *H01F 41/0293* (2013.01); *B22F 2003/248* (2013.01); *B22F 2301/10* (2013.01); *B22F 2301/355* (2013.01); *B22F 2301/45* (2013.01); *B22F 2998/10* (2013.01); *C22C 38/00* (2013.01)

(56) References Cited

U.S. PATENT DOCUMENTS

| | | | | |
|---|---|---|---|---|
| 2015/0187494 | A1* | 7/2015 | Lee | H01F 1/0572 335/296 |
| 2015/0211139 | A1* | 7/2015 | Nagasaki | C22C 38/002 148/102 |
| 2017/0263379 | A1* | 9/2017 | Mino | C22F 1/16 |
| 2017/0263380 | A1* | 9/2017 | Mino | B22F 3/24 |
| 2017/0323723 | A1* | 11/2017 | Mino | B22F 3/10 |

FOREIGN PATENT DOCUMENTS

| | | | |
|---|---|---|---|
| JP | 2012-248827 | A | 12/2012 |
| JP | 2012-248828 | A | 12/2012 |

* cited by examiner (a) SEM (b) Tb (c) F (d) Nd (e) Cu (a) SEM (b) Tb (c) F (d) Nd (e) Cu

METHOD FOR PRODUCING R-T-B SINTERED MAGNET

TECHNICAL FIELD

The present invention relates to a method for producing a sintered R-T-B based magnet containing an $R_2T_{14}B$-type compound as a main phase (where R is a rare-earth element; T is Fe or Fe and Co).

BACKGROUND ART

Sintered R-T-B based magnets whose main phase is an $R_2T_{14}B$-type compound are known as permanent magnets with the highest performance, and are used in voice coil motors (VCMs) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible flux loss. In order to avoid irreversible flux losses, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence Br (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, as a method of effectively supplying a heavy rare-earth element RH to a sintered R-T-B based magnet and diffusing it, Patent Documents 1 to 4 disclose methods which perform a heat treatment while a powder mixture of an RH oxide or RH fluoride and any of various metals M, or an alloy containing M, is allowed to exist on the surface of a sintered R-T-B based magnet, thus allowing the RH and M to be efficiently absorbed to the sintered R-T-B based magnet, thereby enhancing $H_{cJ}$ of the sintered R-T-B based magnet.

Patent Document 1 discloses use of a powder mixture of a powder containing M (where M is one, or two or more, selected from among Al, Cu and Zn) and an RH fluoride powder. Patent Document 2 discloses use of a powder of an alloy RTMAH (where M is one, or two or more, selected from among Al, Cu, Zn, In, Si, P, and the like; A is boron or carbon; H is hydrogen), which takes a liquid phase at the heat treatment temperature, and also that a powder mixture of a powder of this alloy and a powder such as RH fluoride may also be used.

Patent Document 3 and Patent Document 4 disclose that, by using a powder mixture including a powder of an RM alloy (where R is a rare-earth element; M is one, or two or more, selected from among Al, Si, C, P, Ti, and the like) and a powder of an M1M2 alloy (M1 and M2 are one, or two or more, selected from among Al, Si, C, P, Ti, and the like), and an RH oxide, it is possible to partially reduce the RH oxide with the RM alloy or the M1M2 alloy during the heat treatment, thus allowing more R to be introduced into the magnet.

CITATION LIST

Patent Literature

[Patent Document 1] Japanese Laid-Open Patent Publication No. 2007-287874

[Patent Document 2] Japanese Laid-Open Patent Publication No. 2007-287875

[Patent Document 3] Japanese Laid-Open Patent Publication No. 2012-248827

[Patent Document 4] Japanese Laid-Open Patent Publication No. 2012-248828

SUMMARY OF INVENTION

Technical Problem

The methods described in Patent Documents 1 to 4 deserve attention in that they allow more RH to be diffused into a magnet. However, these methods cannot effectively exploit the RH which is present on the magnet surface in improving $H_{cJ}$, and thus need to be bettered. Especially in Patent Document 3, which utilizes a powder mixture of an RM alloy and an RH oxide, Examples thereof indicate that what is predominant is actually the $H_{cJ}$ improvements that are due to diffusion of the RM alloy, while there is little effect of using an RH oxide, such that the RM alloy presumably does not exhibit much effect of reducing the RH oxide.

The present invention has been made in view of the above circumstances, and aims to provide a method for producing a sintered R-T-B based magnet with high $H_{cJ}$, by reducing the amount of RH to be present on the magnet surface and yet effectively diffusing it inside the magnet.

Solution to Problem

In an illustrative implementation, a method for producing a sintered R-T-B based magnet according to the present invention includes a step of performing a heat treatment at a sintering temperature of the sintered R-T-B based magnet or lower, while a powder of an RLM alloy (where RL is Nd and/or Pr; M is one or more selected from among Cu, Fe, Ga, Co and Ni) and a powder of an RH fluoride (where RH is Dy and/or Tb) are present on the surface of the sintered R-T-B based magnet that is provided. The RLM alloy contains RL in an amount of 50 at % or more, and the melting point thereof is equal to or less than the temperature of the heat treatment. The heat treatment is performed while the RLM alloy powder and the RH fluoride powder are present on the surface of the sintered R-T-B based magnet at a mass ratio of RLM alloy:RH fluoride=96:4 to 5:5.

In a preferred embodiment, the amount of RH element in the powder to be present on the surface of the sintered R-T-B based magnet is 0.03 to 0.35 mg per 1 $mm^2$ of magnet surface.

In one embodiment, the RLM alloy powder and the RH fluoride powder are in a mixed state on the surface of the sintered R-T-B based magnet.

In one embodiment, substantially no powder of any RH oxide is present on the surface of the sintered R-T-B based magnet.

In one embodiment, a part of the RH fluoride is an RH oxyfluoride.

Advantageous Effects of Invention

According to an embodiment of the present invention, an RLM alloy is able to reduce an RH fluoride with a higher efficiency than conventional, thus allowing RH to be diffused inside a sintered R-T-B based magnet. As a result, with a smaller RH amount than in the conventional techniques, $H_{cJ}$ can be improved to a similar level to or higher than by the conventional techniques.

DESCRIPTION OF EMBODIMENTS

Figure 1:
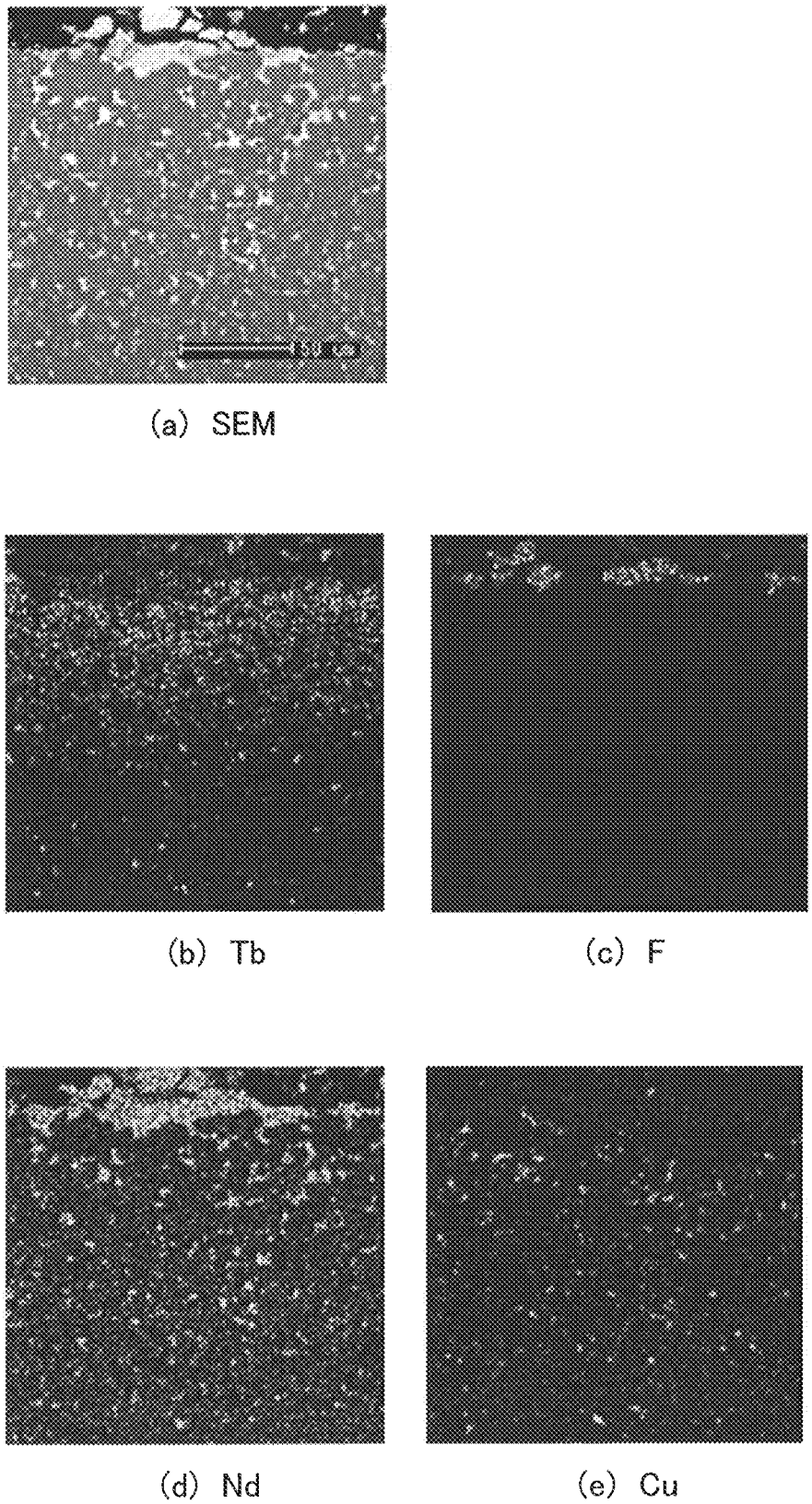
FIG. 1 shows cross-sectional element mapping analysis photographs of an interface of contact between: a mixture (hereinafter, a powder mixture layer) of a diffusion agent and a diffusion auxiliary agent; and a magnet surface.

A method for producing a sintered R-T-B based magnet according to the present invention includes a step of performing a heat treatment at a sintering temperature of the sintered R-T-B based magnet or lower, while a powder of an RLM alloy (where RL is Nd and/or Pr; M is one or more selected from among Cu, Fe, Ga, Co and Ni) and a powder of an RH fluoride (where RH is Dy and/or Tb) are present on the surface of the sintered R-T-B based magnet. The RLM alloy contains RL in an amount of 50 at % or more, and the melting point thereof is equal to or less than the temperature of the heat treatment. The heat treatment is performed while the RLM alloy powder and the RH fluoride powder are present on the surface of the sintered R-T-B based magnet at a mass ratio of RLM alloy:RH fluoride=96:4 to 5:5.

As a method of improving $H_{cJ}$ by making effective use of smaller amounts of RH, the inventor has thought as effective a method which performs a heat treatment while an RH compound is present, on the surface of a sintered R-T-B based magnet, together with a diffusion auxiliary agent that reduces the RH compound during the heat treatment. Through a study by the inventor, it has been found that an alloy (RLM alloy) which combines a specific RL and M, the RLM alloy containing RL in an amount of 50 atom % or more and having a melting point which is equal to or less than the heat treatment temperature, provides an excellent ability to reduce the RH compound that is present on the magnet surface. It has also been found that an RH fluoride is the most effective RH compound in a method which performs a heat treatment with such an RLM alloy, thereby accomplishing the present invention. In the present specification, any substance containing an RH is referred to as a "diffusion agent", whereas any substance that reduces the RH in a diffusion agent so as to render it ready to diffuse is referred to as a "diffusion auxiliary agent".

Hereinafter, preferred embodiments of the present invention will be described in detail.

[Sintered R-T-B Based Magnet Matrix]

First, a sintered R-T-B based magnet matrix, in which to diffuse a heavy rare-earth element RH, is provided in the present invention. In the present specification, for ease of understanding, a sintered R-T-B based magnet in which to diffuse a heavy rare-earth element RH may be strictly differentiated as a sintered R-T-B based magnet matrix; it is to be understood that the term "sintered R-T-B based magnet" is inclusive of any such "sintered R-T-B based magnet matrix". Those which are known can be used as this sintered R-T-B based magnet matrix, having the following composition, for example.

rare-earth element R: 12 to 17 at %

B ((boron), part of which may be replaced with C (carbon)): 5 to 8 at % additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %

T (transition metal element, which is mainly Fe and may include Co) and inevitable impurities: balance Herein, the rare-earth element R consists essentially of a light rare-earth element RL (which is at least one element selected from Nd and Pr), but may contain a heavy rare-earth element RH. In the case where a heavy rare-earth element is to be contained, preferably at least one of Dy and Tb is contained.

A sintered R-T-B based magnet matrix of the above composition is produced by any arbitrary production method.

[Diffusion Auxiliary Agent]

As the diffusion auxiliary agent, a powder of an RLM alloy is used. Suitable RL's are light rare-earth elements having a high effect of reducing RH fluorides. Although RL's and M's may also have an effect of diffusing into the magnet to improve $H_{cJ}$, any element should be avoided that is likely to diffuse to the inside of main phase crystal grains and lower $B_r$. From this standpoint of effectiveness of reducing RH fluorides and unlikeliness of diffusing to the inside of main phase crystal grains, RL is Nd and/or Pr, whereas M is one or more selected from among Cu, Fe, Ga, Co and Ni. Among others, use of an Nd—Cu alloy or an Nd—Fe alloy is preferable because Nd's ability to reduce an RH fluoride will be effectively exhibited. As the RLM alloy, an alloy is used which contains RL in an amount of 50 at % or more, such that the melting point thereof is equal to or less than the heat treatment temperature. Such an RLM alloy will efficiently reduce the RH fluoride during the heat treatment, and the RH which has been reduced at a higher rate will diffuse into the sintered R-T-B based magnet, such that it can efficiently improve $H_{cJ}$ of the sintered R-T-B based magnet even in a small amount. The particle size of the RLM alloy powder is preferably 500 μm or less.

[Diffusion Agent]

As the diffusion agent, a powder of an RH fluoride (where RH is Dy and/or Tb) is used. According to a study of the inventor, it has been found that the effect of $H_{cJ}$ improvement when the aforementioned diffusion auxiliary agent is allowed to coexist on the surface of the sintered R-T-B based magnet for a heat treatment is greater for RH fluorides than RH oxides. The particle size of the RH fluoride powder is preferably 100 μm or less. Note that an RH fluoride in the meaning of the present invention may also include an RH oxyfluoride, which could be an intermediate substance during the production steps of an RH fluoride.

[Diffusive Heat Treatment]

Any method may be adopted which allows the RLM alloy powder and the RH fluoride powder to be present on the surface of the sintered R-T-B based magnet. Examples thereof include: a method which spreads the RLM alloy powder and the RH fluoride powder over the surface of the sintered R-T-B based magnet; a method which disperses the RLM alloy powder and the RH fluoride powder in a solvent such as pure water or an organic solvent, into which the sintered R-T-B based magnet is immersed and then retrieved therefrom; a method in which a slurry is produced by mixing the RLM alloy powder and the RH fluoride powder with a binder and/or a solvent, this slurry being applied onto the surface of the sintered R-T-B based magnet; and so on. Without particular limitation, any binder and/or solvent may be used that can be removed via pyrolysis or evaporation, etc., from the surface of the sintered R-T-B based magnet at a temperature which is equal to or less than the melting point of the diffusion auxiliary agent during the temperature elevating process in a subsequent heat treatment. Examples of binders include polyvinyl alcohol and ethyl cellulose. Moreover, the RLM alloy powder and the RH fluoride powder may be present in an intermixed state on the surface of the sintered R-T-B based magnet, or be separately present. In the method of the present invention, the RLM alloy melts during the heat treatment because of its melting point being equal to or less than the heat treatment temperature, so that the surface of the sintered R-T-B based magnet is in a state which allows the reduced RH to easily diffuse to the inside of the sintered R-T-B based magnet. Therefore, no particular cleansing treatment, e.g., pickling, needs to be performed for the surface of the sintered R-T-B based magnet prior to introducing the RLM alloy powder and the RH fluoride powder onto the surface of the sintered R-T-B based magnet. Of course, this is not to say that such a cleansing treatment should be avoided. Even if the surface of the RLM alloy powder particles is somewhat oxidized, the effect of reducing the RH fluoride will hardly be affected.

The ratio by which the RLM alloy and the RH fluoride in powder state are present on the surface of the sintered R-T-B based magnet (before the heat treatment) is, by mass ratio, RLM alloy:RH fluoride=96:4 to 5:5. More preferably, the ratio by which they are present is, RLM alloy:RH fluoride=95:5 to 6:4. Although the present invention does not necessarily exclude presence of any powder (third powder) other than the RLM alloy and RH fluoride powders on the surface of the sintered R-T-B based magnet, care must be taken so that any third powder will not hinder the RH in the RH fluoride from diffusing to the inside of the sintered R-T-B based magnet. It is desirable that the "RLM alloy and RH fluoride" powders account for a mass ratio of 70% or more in all powder that is present on the surface of the sintered R-T-B based magnet. In one implementation, substantially no powder of any RH oxide is present on the surface of the sintered R-T-B based magnet.

According to the present invention, it is possible to efficiently improve $H_{cJ}$ of the sintered R-T-B based magnet with a small amount of RH. The amount of RH element in the powder to be present on the surface of the sintered R-T-B based magnet is preferably 0.03 to 0.35 mg per 1 $mm^2$ of magnet surface, and more preferably 0.05 to 0.25 mg.

While the RLM alloy powder and the RH fluoride powder are allowed to be present on the surface of the sintered R-T-B based magnet, a heat treatment is performed. Since the RLM alloy powder will melt after the heat treatment is begun, the RLM alloy does not always need to maintain a "powder" state during the heat treatment. The ambient for the heat treatment is preferably a vacuum, or an inert gas ambient. The heat treatment temperature is a temperature which is equal to or less than the sintering temperature (specifically, e.g. 1000° C. or less) of the sintered R-T-B based magnet, and yet higher than the melting point of the RLM alloy. The heat treatment time is 10 minutes to 72 hours, for example. After the above heat treatment, a further heat treatment may be conducted, as necessary, at 400 to 700° C. for 10 minutes to 72 hours.

EXAMPLES

Experimental Example 1

First, by a known method, a sintered R-T-B based magnet with the following mole fractions was produced: Nd=13.4, B=5.8, Al=0.5, Cu=0.1, Co=1.1, balance=Fe (at %). By machining this, a sintered R-T-B based magnet matrix which was 6.9 mm×7.4 mm×7.4 mm was obtained. Magnetic characteristics of the resultant sintered R-T-B based magnet matrix were measured with a B-H tracer, which indicated an $H_{cJ}$ of 1035 kA/m and a $B_r$ of 1.45 T. As will be described later, magnetic characteristics of the sintered R-T-B based magnet having undergone the heat treatment are to be measured only after the surface of the sintered R-T-B based magnet is removed via machining. Accordingly, the sintered R-T-B based magnet matrix also had its surface removed via machining by 0.2 mm each, thus resulting in a 6.5 mm×7.0 mm×7.0 mm size, before the measurement was taken. The amounts of impurities in the sintered R-T-B based magnet matrix was separately measured with a gas analyzer, which showed oxygen to be 760 ppm, nitrogen 490 ppm, and carbon 905 ppm.

Next, a diffusion auxiliary agent having the composition $Nd_{70}Cu_{30}$ (at %) was provided. The diffusion auxiliary agent was obtained by using a coffee mill to pulverize an alloy ribbon which had been produced by rapid quenching technique, resulting in a particle size of 150 μm or less. A powder of the resultant diffusion auxiliary agent, and a $TbF_3$ powder or a $DyF_3$ powder with a particle size of 20 μm or less, were mixed according to the mixing ratios shown in Table 1, whereby powder mixtures were obtained. Over a 8 mm by 8 mm range on an Mo plate, 64 mg of the powder mixture was spread, upon which the sintered R-T-B based magnet matrix was placed with a 7.4 mm×7.4 mm face down. The amount of Tb or Dy per 1 $mm^2$ of the surface of the sintered R-T-B based magnet (diffusion surface) that was in contact with the spread powder mixture at this time is as shown in Table 1. Note that the melting point of the diffusion auxiliary agent, as will be discussed in this Example, denotes a value as read from a binary phase diagram of RLM. The Mo plate having this sintered R-T-B based magnet matrix placed thereon was accommodated in a process chamber (vessel), which was then lidded. (This lid does not hinder gases from going into and coming out of the chamber). This was accommodated in a heat treatment furnace, and in an Ar ambient of 100 Pa, a heat treatment was performed at 900° C. for 4 hours. As for the heat treatment, by warming up from room temperature with evacuation so that the ambient pressure and temperature met the aforementioned conditions, the heat treatment was performed under the aforementioned conditions. Thereafter, once cooled down to room temperature, the Mo plate was taken out and the sintered R-T-B based magnet was collected. The collected sintered R-T-B based magnet was returned in the process chamber, and again accommodated in the heat treatment furnace, and 2 hours of heat treatment was performed at 500° C. in a vacuum of 10 Pa or less. Regarding this heat treatment, too, by warming up from room temperature with evacuation so that the ambient pressure and temperature met the aforementioned conditions, the heat treatment was performed under the aforementioned conditions. Thereafter, once cooled down to room temperature, the sintered R-T-B based magnet was collected. Note that, as described above, this Experimental Example is an experiment where the powder mixture was spread over only one diffusion surface of the sintered R-T-B based magnet matrix, for a comparison of $H_{cJ}$ improvement effects.

The surface of the resultant sintered R-T-B based magnet was removed via machining by 0.2 mm each, thus providing Samples 1 to 9 which were 6.5 mm×7.0 mm×7.0 mm. Magnetic characteristics of Samples 1 to 9 thus obtained were measured with a B-H tracer, and variations in $H_{cJ}$ and $B_r$ were determined. The results are shown in Table 2.

TABLE 1

| Sample No. | diffusion auxiliary agent composition (at. ratio) | melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 1 | $Nd_{70}Cu_{30}$ | 520 | $TbF_3$ | 4:6 | 0.44 | Comparative Example |
| 2 | $Nd_{70}Cu_{30}$ | 520 | $TbF_3$ | 6:4 | 0.30 | Example |
| 3 | $Nd_{70}Cu_{30}$ | 520 | $TbF_3$ | 8:2 | 0.15 | Example |
| 4 | $Nd_{70}Cu_{30}$ | 520 | $TbF_3$ | 9:1 | 0.07 | Example |
| 5 | $Nd_{70}Cu_{30}$ | 520 | $TbF_3$ | 96:4 | 0.03 | Example |
| 6 | $Nd_{70}Cu_{30}$ | 520 | $DyF_3$ | 8:2 | 0.15 | Example |
| 7 | $Nd_{70}Cu_{30}$ | 520 | None | — | 0.00 | Comparative Example |
| 8 | None | — | $TbF_3$ | — | 0.74 | Comparative Example |
| 9 | None | — | $DyF_3$ | — | 0.74 | Comparative Example |

TABLE 2

| Sample No. | $H_{cJ}$ (kA/m) | $B_r$(T) | $\Delta H_{cJ}$ (kA/m) | $\Delta$Br (T) | |
|---|---|---|---|---|---|
| 1 | 1172 | 1.45 | 137 | 0.00 | Comparative Example |
| 2 | 1217 | 1.44 | 182 | −0.01 | Example |
| 3 | 1253 | 1.44 | 218 | −0.01 | Example |
| 4 | 1234 | 1.45 | 199 | 0.00 | Example |
| 5 | 1213 | 1.44 | 178 | −0.01 | Example |
| 6 | 1190 | 1.44 | 155 | −0.01 | Example |
| 7 | 1053 | 1.45 | 18 | 0.00 | Comparative Example |
| 8 | 1049 | 1.45 | 14 | 0.00 | Comparative Example |
| 9 | 1049 | 1.45 | 14 | 0.00 | Comparative Example |

As can be seen from Table 2, $H_{cJ}$ is significantly improved without lowering $B_r$ in the sintered R-T-B based magnets according to the production method of the present invention; on the other hand, in Sample 1 having more RH fluoride than defined by the mixed mass ratio according to the present invention, the $H_{cJ}$ improvement was not comparable to that attained by the present invention, despite the much larger RH amount per 1 mm² of diffusion surface of the sintered R-T-B based magnet than in the present invention. Moreover, the $H_{cJ}$ improvement was not comparable to that attained by the present invention in Sample 7 having less RH fluoride than defined by the mixed mass ratio according to the present invention (i.e., with no RH fluoride being mixed), and in Samples 8 and 9 having nothing but RH fluoride, despite their much larger RH amount per 1 mm² of diffusion surface of the sintered R-T-B based magnet than in Examples of the present invention. Thus, it was found that, only in the case where an RLM alloy and an RH fluoride as defined by the present invention were mixed at the mixed mass ratio as defined by the present invention did the RLM alloy efficiently reduce the RH fluoride, such that the sufficiently-reduced RH diffused into the sintered R-T-B based magnet matrix to significantly improve $H_{cJ}$ with only a small RH amount.

Moreover, a magnet with an unmachined surface was produced, following the same conditions as in Sample 3 up to the heat treatment. With an EPMA (electron probe micro analyzer), this magnet was subjected to a cross-sectional element mapping analysis regarding the interface of contact between a mixture of a diffusion agent and a diffusion auxiliary agent and the magnet surface, as well as a cross-sectional element mapping analysis of a position at a depth of 200 μm from this interface.

FIG. 1 shows cross-sectional element mapping analysis photographs of an interface of contact between the mixture of a diffusion agent and a diffusion auxiliary agent (hereinafter referred to as the "powder mixture layer") and the magnet surface. FIG. 1(*a*) is a SEM image, whereas FIGS. 1(*b*), (*c*), (*d*) and (*e*) are element mappings of Tb, fluorine (F), Nd and Cu, respectively.

As can be seen from FIG. 1, at the powder mixture layer side of the interface of contact, fluorine was detected together with Nd, with only very small amounts of Tb being detected at the portions where fluorine was detected. At the magnet side of the interface of contact, Tb was detected, but fluorine was not detected. At the magnet side of the interface of contact, Nd was detected, but the portions where Nd was detected hardly matched the portions where Tb was detected. More specifically, Nd was detected in small amounts within the main phase of the magnet, and profusely detected at grain boundary triple junctions. These are mostly considered to correspond to the Nd which was originally contained in the matrix. Although Cu was detected at the magnet side of the interface of contact, it was hardly detected at the powder mixture layer side.

From the above, it is considered that, among the components constituting the powder mixture layer, large parts of Tb and Cu had diffused to the inside of the magnet, whereas large parts of fluorine and Nd remained at the powder mixture layer side.

Figure 2:
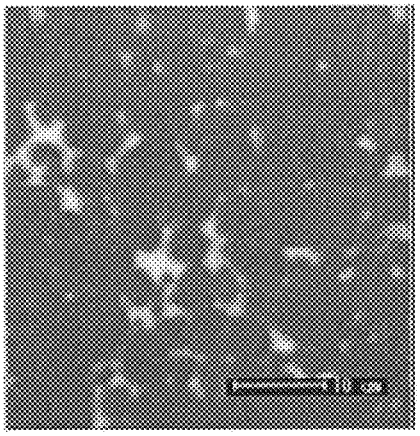
FIG. 2 shows cross-sectional element mapping analysis photographs of a position at a depth of 200 μm from the interface.
Figure 2:
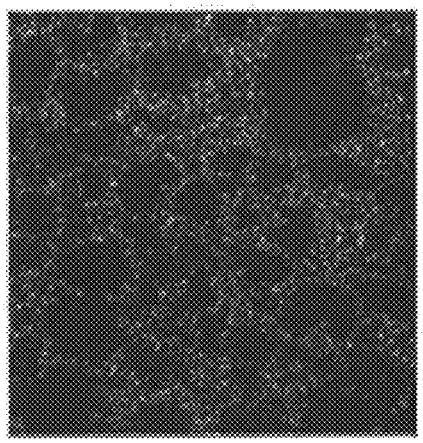
Figure 2:
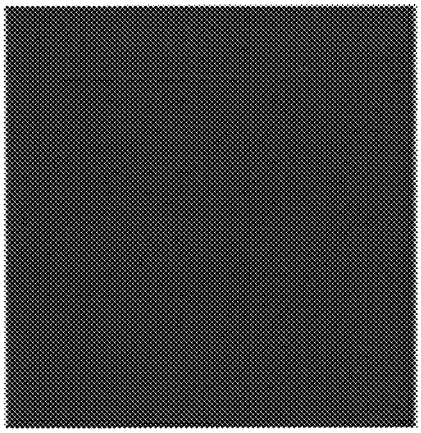
Figure 2:
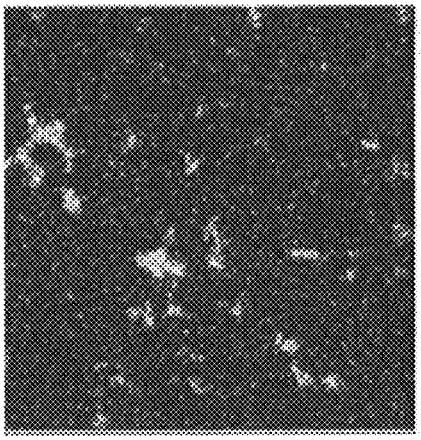
Figure 2:
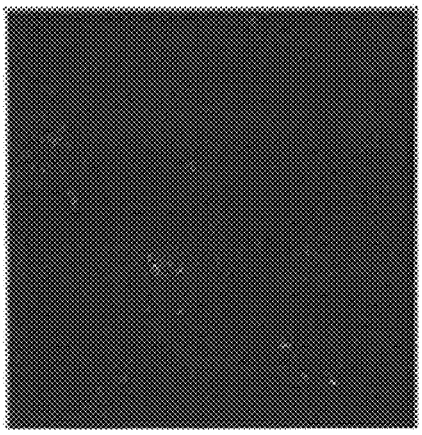

FIG. 2 shows cross-sectional element mapping analysis photographs of a position at a depth of 200 μm from the interface. FIG. 2(*a*) is a SEM image, whereas FIGS. 2(*b*), (*c*), (*d*) and (*e*) are element mappings of Tb, fluorine (F), Nd and Cu, respectively.

As can be seen from FIGS. 2(*b*) and (*c*), at this position, Tb was detected at the crystal grain boundary in mesh shape, while no fluorine was detected. From this, it can be seen that only Tb had diffused into the magnet, while no fluorine had diffused from the diffusion agent $TbF_3$. Moreover, Cu, which in FIG. 1 was hardly detected at the powder mixture side but detected at the magnet surface side, was also detected at this position (position at a depth of 200 μm from the magnet surface) as indicated in FIG. 2(*e*). Furthermore, as FIG. 2(*d*) indicates, also at this position, small amounts of Nd were detected in the main phase of the magnet, and large amounts of Nd were detected at grain boundary triple junctions. These are mostly considered to correspond to the Nd which was originally contained in the matrix.

Taking together the results of FIG. 1 and the results of FIG. 2, it is considered that the diffusion agent $TbF_3$ was for the most part reduced by the diffusion auxiliary agent $Nd_{70}Cu_{30}$, and that most of Tb and Cu diffused into the sintered R-T-B based magnet matrix. Moreover, it is considered that the fluorine in the diffusion agent remained in the powder mixture, together with the Nd in the diffusion auxiliary agent.

Figure 3:
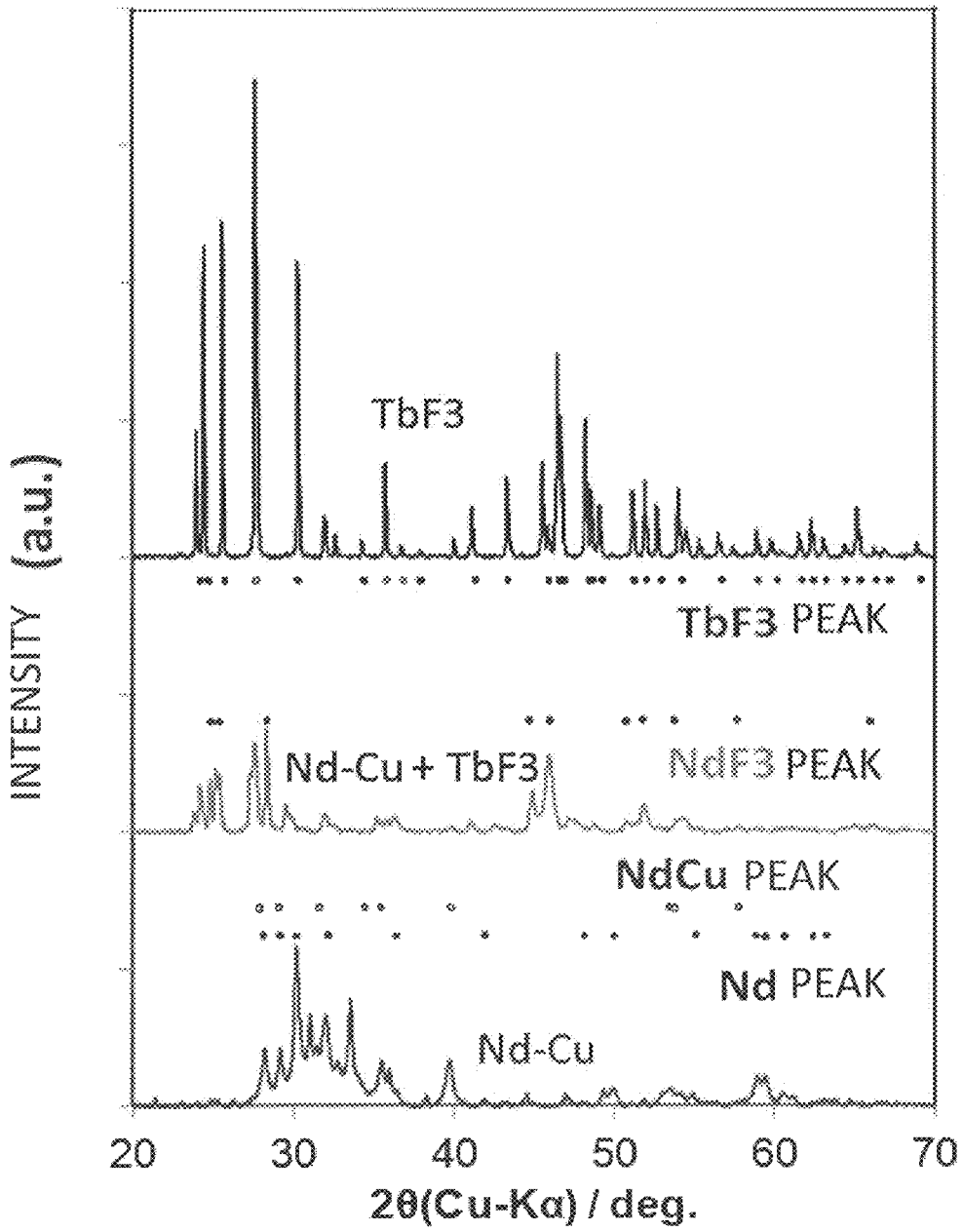
FIG. 3 shows, in this order from top to bottom: X-ray diffraction data of a diffusion agent ($TbF_3$) used for Sample 2; X-ray diffraction data of what is obtained by subjecting a powder mixture of the diffusion auxiliary agent and the diffusion agent used in Sample 2 to four hours of heat treatment at 900° C.; and X-ray diffraction data of the diffusion auxiliary agent (Nd70Cu30) used in Sample 2.

In order to study what is caused in the diffusion auxiliary agent and the diffusion agent by the heat treatment, the diffusion agent and the diffusion auxiliary agent before the heat treatment, and the powder mixture after the heat treatment, were subjected to an analysis by X-ray diffraction technique. FIG. 3 shows, in this order from top to bottom: X-ray diffraction data of the diffusion agent ($TbF_3$) used for Sample 2; X-ray diffraction data of what is obtained by subjecting a powder mixture of the diffusion auxiliary agent and the diffusion agent used in Sample 2 to four hours of heat treatment at 900° C.; and X-ray diffraction data of the diffusion auxiliary agent ($Nd_{70}Cu_{30}$) used in Sample 2. Main diffraction peaks of the diffusion agent are the $TbF_3$ peaks, whereas main diffraction peaks of the diffusion auxiliary agent are the Nd and NdCu peaks. On the other hand, in the X-ray diffraction data of what is obtained by subjecting the powder mixture to a heat treatment, the diffraction peaks of $TbF_3$, Nd and NdCu disappeared, while $NdF_3$ diffraction peaks exhibit themselves as main diffraction peaks. Thus it can be seen that, through the heat treatment, the diffusion auxiliary agent of the composition $Nd_{70}Cu_{30}$ reduced the diffusion agent $TbF_3$ for the most part, whereby Nd combined with fluorine.

Figure 4:
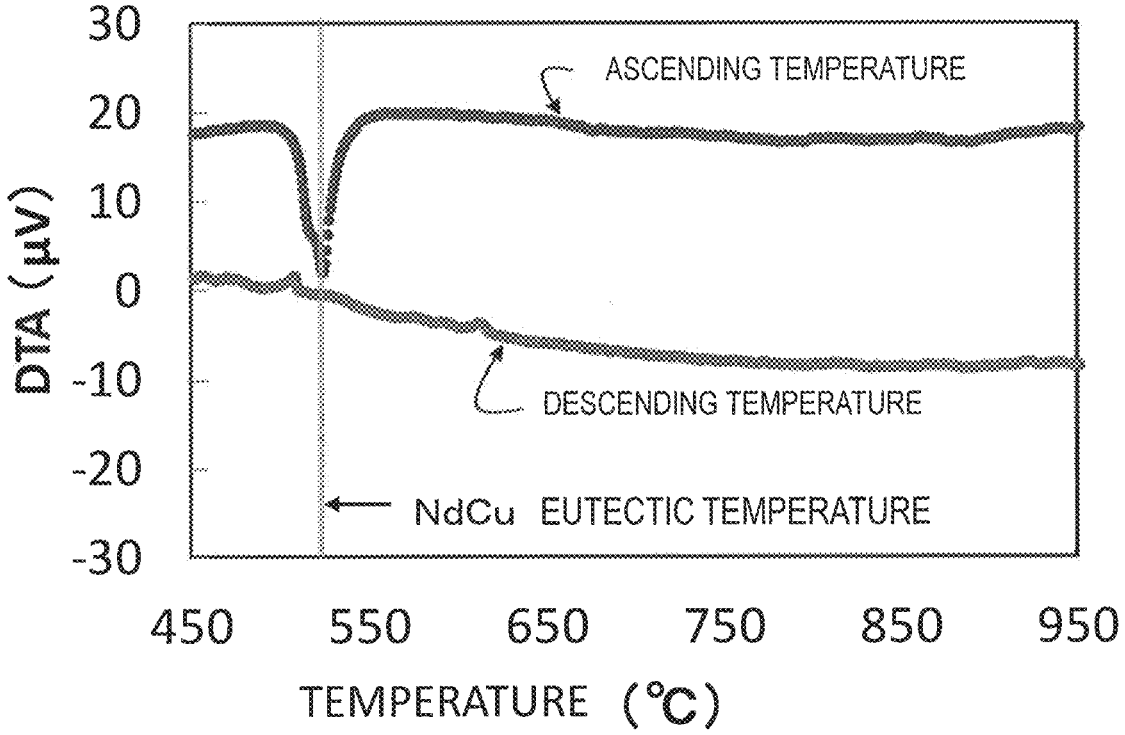
FIG. 4 shows thermal analysis data of the powder mixture of the diffusion auxiliary agent and the diffusion agent used in Sample 2.

FIG. 4 shows differential thermal analysis (DTA) data of the powder mixture of the diffusion auxiliary agent and the diffusion agent used in Sample 2. The vertical axis represents temperature difference occurring between a reference substance (primary standard) and the sample, whereas the horizontal axis represents temperature. During ascending temperature, a melting endothermic peak is observed near the eutectic temperature of $Nd_{70}Cu_{30}$; during descending temperature, however, hardly any solidification exothermic peaks are observed. The result of this thermal analysis indicates that, for the most part, $Nd_{70}Cu_{30}$ disappeared through the heat treatment of the powder mixture.

From the above, the significant improvement in $H_{cJ}$ in the sintered R-T-B based magnets according to the production method of the present invention is considered to be because the RLM alloy, as a diffusion auxiliary agent, reduced the RH fluoride for the most part so that RL combined with fluorine, while the reduced RH diffused to the inside of the magnet through the grain boundary, thus efficiently contributing to the $H_{cJ}$ improvement. The fact that fluorine is hardly detected inside the magnet, i.e., that fluorine does not intrude to the inside of the magnet, may be considered as a factor which prevents $B_r$ from being significantly lowered.

Experimental Example 2

Samples 10 to 16 were obtained in a similar manner to Experimental Example 1, except for using a diffusion auxiliary agent of the composition $Nd_{80}Fe_{20}$ (at %) and using powder mixtures obtained through mixing with a $TbF_3$ powder or a $DyF_3$ powder according to the mixing ratios shown in Table 3. Magnetic characteristics of Samples 10 to 16 thus obtained were measured with a B-H tracer, and variations in $H_{cJ}$ and $B_r$ were determined. The results are shown in Table 4.

TABLE 3

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 10 | $Nd_{80}Fe_{20}$ | 690 | $TbF_3$ | 4:6 | 0.44 | Comparative Example |
| 11 | $Nd_{80}Fe_{20}$ | 690 | $TbF_3$ | 7:3 | 0.22 | Example |
| 12 | $Nd_{80}Fe_{20}$ | 690 | $TbF_3$ | 8:2 | 0.15 | Example |
| 13 | $Nd_{80}Fe_{20}$ | 690 | $TbF_3$ | 9:1 | 0.07 | Example |
| 14 | $Nd_{80}Fe_{20}$ | 690 | $TbF_3$ | 93:7 | 0.05 | Example |
| 15 | $Nd_{80}Fe_{20}$ | 690 | $DyF_3$ | 8:2 | 0.15 | Example |
| 16 | $Nd_{80}Fe_{20}$ | 690 | None | — | 0.00 | Comparative Example |

TABLE 4

| Sample No. | $H_{cJ}$ (kA/m) | $B_r$(T) | $\Delta H_{cJ}$ (kA/m) | $\Delta$Br (T) | |
|---|---|---|---|---|---|
| 10 | 1111 | 1.45 | 76 | 0.00 | Comparative Example |
| 11 | 1212 | 1.45 | 177 | 0.00 | Example |
| 12 | 1230 | 1.45 | 195 | 0.00 | Example |
| 13 | 1220 | 1.44 | 185 | −0.01 | Example |
| 14 | 1208 | 1.45 | 173 | 0.00 | Example |

TABLE 4-continued

| Sample No. | $H_{cJ}$ (kA/m) | $B_r$(T) | ⊿$H_{cJ}$ (kA/m) | ⊿Br (T) | |
|---|---|---|---|---|---|
| 15 | 1149 | 1.44 | 114 | −0.01 | Example |
| 16 | 1068 | 1.45 | 33 | 0.00 | Comparative Example |

As can be seen from Table 4, also in the case of using $Nd_{80}Fe_{20}$ as the diffusion auxiliary agent, $H_{cJ}$ was significantly improved without lowering $B_r$ in the sintered R-T-B based magnets according to the production method of the present invention. However, in Sample 10 having more RH fluoride than defined by the mixed mass ratio according to the present invention, the $H_{cJ}$ improvement was not comparable to that attained by the present invention, despite the much larger RH amount per 1 $mm^2$ of diffusion surface of the sintered R-T-B based magnet than in the present invention. Moreover, also in Sample 16 having less RH fluoride than defined by the mixed mass ratio according to the present invention (i.e., with no RH fluoride being mixed), the $H_{cJ}$ improvement was not comparable to that attained by the present invention. Thus, it was found also with respect to the case of using $Nd_{80}Fe_{20}$ as the diffusion auxiliary agent that, only in the case where an RLM alloy and an RH fluoride as defined by the present invention were mixed at the mixed mass ratio as defined by the present invention did the RLM alloy efficiently reduce the RH fluoride, such that the sufficiently-reduced RH diffused into the sintered R-T-B based magnet matrix to significantly improve $H_{cJ}$ with only a small RH amount.

Experimental Example 3

Samples 17 to 24, and 54 to 56, were obtained in a similar manner to Experimental Example 1, except for using diffusion auxiliary agents of the compositions shown in Table 5 and using powder mixtures obtained through mixing with a $TbF_3$ powder according to the mixing ratio shown in Table 5. Magnetic characteristics of Samples 17 to 24 and 54 to 56 thus obtained were measured with a B-H tracer, and variations in $H_{cJ}$ and $B_r$ were determined. The results are shown in Table 6.

TABLE 5

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 54 | $Nd_{90}Cu_{10}$ | 860 | $TbF_3$ | 9:1 | 0.07 | Example |
| 17 | $Nd_{85}Cu_{15}$ | 770 | $TbF_3$ | 9:1 | 0.07 | Example |
| 18 | $Nd_{50}Cu_{50}$ | 690 | $TbF_3$ | 9:1 | 0.07 | Example |
| 19 | $Nd_{90}Fe_{10}$ | 860 | $TbF_3$ | 9:1 | 0.07 | Example |
| 20 | $Nd_{66}Fe_{34}$ | 840 | $TbF_3$ | 9:1 | 0.07 | Example |
| 21 | $Nd_{27}Cu_{73}$ | 770 | $TbF_3$ | 9:1 | 0.07 | Comparative Example |
| 22 | $Nd_{80}Ga_{20}$ | 650 | $TbF_3$ | 9:1 | 0.07 | Example |
| 23 | $Nd_{80}Co_{20}$ | 630 | $TbF_3$ | 9:1 | 0.07 | Example |
| 24 | $Nd_{80}Ni_{20}$ | 580 | $TbF_3$ | 9:1 | 0.07 | Example |
| 55 | $Pr_{68}Cu_{32}$ | 470 | $TbF_3$ | 9:1 | 0.07 | Example |
| 56 | $Nd_{55}Pr_{154}Cu_{30}$ | 510 | $TbF_3$ | 9:1 | 0.07 | Example |

TABLE 6

| Sample No. | $H_{cJ}$ (kA/m) | $B_r$(T) | ⊿$H_{cJ}$ (kA/m) | ⊿Br (T) | |
|---|---|---|---|---|---|
| 54 | 1209 | 1.44 | 174 | −0.01 | Example |
| 17 | 1226 | 1.44 | 191 | −0.01 | Example |
| 18 | 1216 | 1.44 | 181 | −0.01 | Example |
| 19 | 1212 | 1.45 | 177 | 0.00 | Example |
| 20 | 1223 | 1.44 | 188 | −0.01 | Example |
| 21 | 1060 | 1.45 | 25 | 0.00 | Comparative Example |
| 22 | 1220 | 1.45 | 185 | 0.00 | Example |
| 23 | 1229 | 1.45 | 194 | 0.00 | Example |
| 24 | 1229 | 1.44 | 194 | −0.01 | Example |
| 55 | 1249 | 1.44 | 214 | −0.01 | Example |
| 56 | 1244 | 1.44 | 209 | −0.01 | Example |

As can be seen from Table 6, also in the case of using diffusion auxiliary agents of different compositions from those of the diffusion auxiliary agents used in Experimental Examples 1 and 2 (Samples 17 to 20, 22 to 24, and 54 to 56), $H_{cJ}$ is significantly improved without lowering $B_r$ in the sintered R-T-B based magnets according to the production method of the present invention. However, in Sample 21 where a diffusion auxiliary agent with less than 50 at % of an RL was used, the $H_{cJ}$ improvement was not comparable to that attained by the present invention.

Experimental Example 4

Samples 25 to 30 were obtained in a similar manner to Experimental Example 1, except for using diffusion auxiliary agents of the compositions shown in Table 7, using powder mixtures obtained through mixing with a $TbF_3$ powder according to the mixing ratio shown in Table 7, and performing a heat treatment under conditions shown in Table 8. Magnetic characteristics of Samples 25 to 30 thus obtained were measured with a B-H tracer, and variations in $H_{cJ}$ and $B_r$ were determined. The results are shown in Table 9.

TABLE 7

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 25 | $Nd_{70}Cu_{30}$ | 520 | $TbF_3$ | 9:1 | 0.07 | Example |
| 26 | $Nd_{70}Cu_{30}$ | 520 | $TbF_3$ | 9:1 | 0.07 | Example |
| 27 | $Nd_{70}Cu_{30}$ | 520 | $TbF_3$ | 9:1 | 0.07 | Example |
| 28 | $Nd_{80}Fe_{20}$ | 690 | $TbF_3$ | 9:1 | 0.07 | Example |
| 29 | $Nd_{80}Fe_{20}$ | 690 | $TbF_3$ | 9:1 | 0.07 | Example |
| 30 | $Nd_{80}Fe_{20}$ | 690 | $TbF_3$ | 9:1 | 0.07 | Example |

TABLE 8

| Sample No. | diffusion temperature (° C.) | diffusion time (Hr) | |
|---|---|---|---|
| 25 | 900 | 8 | Example |
| 26 | 950 | 4 | Example |
| 27 | 850 | 16 | Example |
| 28 | 900 | 8 | Example |
| 29 | 950 | 4 | Example |
| 30 | 850 | 16 | Example |

TABLE 9

| Sample No. | $H_{cJ}$ (kA/m) | $B_r$(T) | ⊿$H_{cJ}$ (kA/m) | ⊿Br (T) | |
|---|---|---|---|---|---|
| 25 | 1274 | 1.45 | 239 | 0.00 | Example |
| 26 | 1282 | 1.44 | 247 | −0.01 | Example |
| 27 | 1253 | 1.44 | 218 | −0.01 | Example |
| 28 | 1263 | 1.44 | 228 | −0.01 | Example |
| 29 | 1275 | 1.44 | 240 | −0.01 | Example |
| 30 | 1232 | 1.45 | 197 | 0.00 | Example |

As can be seen from Table 9, also in the case where a heat treatment is performed under various heat treatment conditions as shown in Table 8, $H_{cJ}$ is significantly improved without lowering $B_r$ in the sintered R-T-B based magnets according to the production method of the present invention.

Experimental Example 5

Sample 31 was obtained in a similar manner to Sample 4, except that the sintered R-T-B based magnet matrix had the composition, amounts of impurities, and magnetic characteristics shown at Sample 31 in Table 10. Likewise, Samples 32 and 33 were obtained in a similar manner to Sample 13, except that the sintered R-T-B based magnet matrix had the composition, amounts of impurities, and magnetic characteristics shown at Samples 32 and 33 in Table 10. Magnetic characteristics of Samples 31 to 33 thus obtained were measured with a B-H tracer, and variations in $H_{cJ}$ and $B_r$ were determined. The results are shown in Table 11.

TABLE 10

| Sample No. | matrix composition (at %) | amounts of impurities (ppm) oxygen | nitrogen | carbon | matrix $H_{cJ}$ (kA/m) | matrix $B_r$ (T) |
|---|---|---|---|---|---|---|
| 31 | $Nd_{13.4}B_{5.8}Al_{0.5}CU_{0.1}Fe_{bal.}$ | 810 | 520 | 980 | 1027 | 1.44 |
| 32 | $Nd_{12.6}Dy_{0.8}B_{5.8}Al_{0.5}Cu_{0.1}Co_{1.1}Fe_{bal.}$ | 780 | 520 | 930 | 1205 | 1.39 |
| 33 | $Nd_{13.7}B_{5.8}Al_{0.5}Cu_{0.1}Co_{1.1}Fe_{bal.}$ | 1480 | 450 | 920 | 1058 | 1.44 |

TABLE 11

| Sample No. | $H_{cJ}$ (kA/m) | $B_r$(T) | ⊿$H_{cJ}$ (kA/m) | ⊿Br (T) | |
|---|---|---|---|---|---|
| 31 | 1217 | 1.44 | 190 | 0.00 | Example |
| 32 | 1383 | 1.38 | 178 | −0.01 | Example |
| 33 | 1262 | 1.43 | 204 | 0.00 | Example |

As can be seen from Table 11, even in the case where various sintered R-T-B based magnet matrices as shown in Table 10 are used, $H_{cJ}$ is significantly improved without lowering $B_r$ in the sintered R-T-B based magnets according to the production method of the present invention.

Experimental Example 6

Samples 34 to 39 were obtained in a similar manner to Experimental Example 1, except for using diffusion auxiliary agents shown in Table 12, using powder mixtures obtained through mixing with a $TbF_3$ powder or a $Tb_4O_7$ powder according to the mixing ratios shown in Table 12, and performing a heat treatment under conditions shown in Table 13. Magnetic characteristics of Samples 34 to 39 thus obtained were measured with a B-H tracer, and variations in $H_{cJ}$ and $B_r$ were determined. The results are shown in Table 14. Note that each Table indicates the conditions and measurement results for Sample 4, as an Example for comparison.

TABLE 12

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 4 | $Nd_{70}Cu_{30}$ | 520 | $TbF_3$ | 9:1 | 0.07 | Example |
| 34 | Cu | 1080 | $TbF_3$ | 9:1 | 0.07 | Comparative Example |
| 35 | Al | 660 | $TbF_3$ | 9:1 | 0.07 | Comparative Example |
| 36 | Al | 660 | $TbF_3$ | 1:9 | 0.67 | Comparative Example |
| 37 | Al | 660 | $TbF_3$ | 2:98 | 0.73 | Comparative Example |
| 38 | Cu | 1080 | $Tb_4O_7$ | 9:1 | 0.08 | Comparative Example |
| 39 | Al | 660 | $Tb_4O_7$ | 9:1 | 0.08 | Comparative Example |

TABLE 13

| Sample No. | diffusion temperature (° C.) | diffusion time (Hr) | |
|---|---|---|---|
| 4 | 900 | 4 | Example |
| 34 | 900 | 4 | Comparative Example |
| 35 | 900 | 4 | Comparative Example |
| 36 | 900 | 4 | Comparative Example |
| 37 | 800 | 20 | Comparative Example |
| 38 | 900 | 4 | Comparative Example |
| 39 | 900 | 4 | Comparative Example |

TABLE 14

| Sample No. | $H_{cJ}$ (kA/m) | $B_r$(T) | $\Delta H_{cJ}$ (kA/m) | $\Delta$Br (T) | |
|---|---|---|---|---|---|
| 4 | 1234 | 1.45 | 199 | 0.00 | Example |
| 34 | 1055 | 1.45 | 20 | 0.00 | Comparative Example |
| 35 | 1153 | 1.42 | 118 | −0.03 | Comparative Example |
| 36 | 1098 | 1.44 | 63 | −0.01 | Comparative Example |
| 37 | 1067 | 1.45 | 32 | 0.00 | Comparative Example |
| 38 | 1043 | 1.45 | 8 | 0.00 | Comparative Example |
| 39 | 1138 | 1.42 | 103 | −0.03 | Comparative Example |

As can be seen from Table 14, in any of Samples 34 to 39, the $H_{cJ}$ improvement was not comparable to that attained by the present invention. Also in the cases where an RH oxide was used as the diffusion agent, the results were less than par. As the diffusion auxiliary agent, Cu has a melting point which is higher than the heat treatment temperature and has neither an ability to reduce an RH fluoride nor an ability to diffuse on its own to improve $H_{cJ}$; consequently, $H_{cJ}$ was hardly improved. Regarding Al, as the results of Samples 35 to 37 indicate, there is less $H_{cJ}$ improvement as the mixed ratio of Al decreases. On the other hand, $B_r$ becomes increasingly lower as the mixed ratio of Al increases. Thus, it is considered that Al hardly has any effect of reducing an RH fluoride, and that the $H_{cJ}$ improvement in Samples 35 to 37 is ascribable to Al's own diffusion into the sintered R-T-B based magnet. In other words, it is considered that Al, which is likely to react with the main phase crystal grains, diffused to the inside of the main phase crystal grains and consequently lowered $B_r$.

Experimental Example 7

Samples 40 and 41 were obtained in a similar manner to Experimental Example 1, except for using diffusion auxiliary agents of the compositions shown in Table 15 and using powder mixtures obtained through mixing with a $TbF_3$ powder according to the mixing ratio shown in Table 15. Magnetic characteristics of Samples 40 and 41 thus obtained were measured with a B-H tracer, and variations in $H_{cJ}$ and $B_r$ were determined. The results are shown in Table 16. Note that each Table indicates the respective conditions and measurement results for Samples 3 and 12, as Examples for comparison.

TABLE 15

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 3 | $Nd_{70}Cu_{30}$ | 520 | $TbF_3$ | 8:2 | 0.15 | Example |
| 40 | $Tb_{70}Cu_{30}$ | 730 | $TbF_3$ | 8:2 | 0.83 | Comparative Example |
| 12 | $Nd_{80}Fe_{20}$ | 690 | $TbF_3$ | 8:2 | 0.15 | Example |

TABLE 15-continued

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 41 | $Tb_{70}Fe_{30}$ | 880 | $TbF_3$ | 8:2 | 0.84 | Comparative Example |

TABLE 16

| Sample No. | $H_{cJ}$ (kA/m) | $B_r$(T) | ⊿$H_{cJ}$ (kA/m) | ⊿Br (T) | |
|---|---|---|---|---|---|
| 3 | 1253 | 1.44 | 218 | −0.01 | Example |
| 40 | 1259 | 1.43 | 224 | −0.02 | Comparative Example |
| 12 | 1230 | 1.45 | 195 | 0.00 | Example |
| 41 | 1180 | 1.44 | 145 | −0.01 | Comparative Example |

As can be seen from Tables 15 and 16, in the case where an RHM alloy is used as the diffusion auxiliary agent, $H_{cJ}$ is improved to similar degrees as are attained by Examples of the present invention, but the amount of RH per 1 mm² of the surface of the sintered R-T-B based magnet (diffusion surface) is much larger than in the present invention. Thus, the effect of improving $H_{cJ}$ with a small amount of RH is not attained.

Experimental Example 8

Samples 42 and 43 were obtained in a similar manner to Experimental Example 1, except for using diffusion auxiliary agents of the compositions shown in Table 17 and using powder mixtures obtained through mixing with a $Tb_4O_7$ powder according to the mixing ratio shown in Table 17. Magnetic characteristics of Samples 42 and 43 thus obtained were measured with a B-H tracer, and variations in $H_{cJ}$ and $B_r$ were determined. The results are shown in Table 18. Note that each Table indicates the respective conditions and measurement results for Samples 4 and 13, as Examples for comparison.

TABLE 17

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 4 | $Nd_{70}Cu_{30}$ | 520 | $TbF_3$ | 9:1 | 0.07 | Example |
| 42 | $Nd_{70}Cu_{30}$ | 520 | $Tb_4O_7$ | 9:1 | 0.08 | Comparative Example |
| 13 | $Nd_{80}Fe_{20}$ | 690 | $TbF_3$ | 9:1 | 0.07 | Example |
| 43 | $Nd_{80}Fe_{20}$ | 690 | $Tb_4O_7$ | 9:1 | 0.08 | Comparative Example |

TABLE 18

| Sample No. | $H_{cJ}$ (kA/m) | $B_r$(T) | ⊿$H_{cJ}$ (kA/m) | ⊿Br (T) | |
|---|---|---|---|---|---|
| 4 | 1234 | 1.45 | 199 | 0.00 | Example |
| 42 | 1143 | 1.45 | 108 | 0.00 | Comparative Example |

TABLE 18-continued

| Sample No. | $H_{cJ}$ (kA/m) | $B_r$(T) | ⊿$H_{cJ}$ (kA/m) | ⊿Br (T) | |
|---|---|---|---|---|---|
| 13 | 1220 | 1.44 | 185 | −0.01 | Example |
| 43 | 1122 | 1.45 | 87 | 0.00 | Comparative Example |

As can be seen from Table 18, in either of Samples 42 and 43, in which an RH oxide was used as the diffusion agent, the $H_{cJ}$ improvement was not comparable to that attained by the present invention; thus, RH fluorides provide higher effects of $H_{cJ}$ improvement as diffusion agents.

Experimental Example 9

Diffusion auxiliary agents and diffusion agents shown in Table 19 were mixed with polyvinyl alcohol and pure water, thus obtaining slurries. Each slurry was applied onto the two 7.4 mm×7.4 mm faces of the same sintered R-T-B based magnet matrix as in Experimental Example 1, so that the amount of RH per 1 mm² of the surface of the sintered R-T-B based magnet (diffusion surface) had the value shown in Table 19. These were subjected to a heat treatment by the same method as in Experimental Example 1, and the sintered R-T-B based magnet was collected.

The surface of the resultant sintered R-T-B based magnet was removed via machining by 0.2 mm each, thus providing Samples 44 to 53 which were 6.5 mm×7.0 mm×7.0 mm. Magnetic characteristics of Samples 44 to 53 thus obtained were measured with a B-H tracer, and variations in $H_{cJ}$ and $B_r$ were determined. The results are shown in Table 20.

TABLE 19

| Sample No. | diffusion auxiliary agent composition (at. ratio) | melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 44 | $Nd_{70}Cu_{30}$ | 520 | $TbF_3$ | 4:6 | 0.07 | Example |
| 45 | $Nd_{70}Cu_{30}$ | 520 | $TbF_3$ | 5:5 | 0.07 | Example |
| 46 | $Nd_{70}Cu_{30}$ | 520 | $TbF_3$ | 6:4 | 0.07 | Example |
| 47 | $Nd_{70}Cu_{30}$ | 520 | $TbF_3$ | 7:3 | 0.07 | Example |
| 48 | $Nd_{70}Cu_{30}$ | 520 | $TbF_3$ | 8:2 | 0.07 | Example |
| 49 | $Nd_{70}Cu_{30}$ | 520 | $TbF_3$ | 9:1 | 0.07 | Example |
| 50 | $Nd_{70}Cu_{30}$ | 520 | $DyF_3$ | 8:2 | 0.07 | Example |
| 51 | $Nd_{70}Cu_{30}$ | 520 | None | — | 0.00 | Comparative Example |
| 52 | $Nd_{80}Fe_{20}$ | 690 | $TbF_3$ | 8:2 | 0.07 | Example |
| 53 | $Nd_{80}Fe_{20}$ | 690 | $DyF_3$ | 9:1 | 0.07 | Example |

TABLE 20

| Sample No. | $H_{cJ}$ (kA/m) | $B_r$(T) | $\Delta H_{cJ}$ (kA/m) | $\Delta$Br (T) | |
|---|---|---|---|---|---|
| 44 | 1274 | 1.45 | 239 | 0.00 | Comparative Example |
| 45 | 1399 | 1.44 | 364 | −0.01 | Example |
| 46 | 1404 | 1.45 | 369 | 0.00 | Example |
| 47 | 1417 | 1.44 | 382 | −0.01 | Example |
| 48 | 1428 | 1.44 | 393 | −0.01 | Example |
| 49 | 1408 | 1.45 | 373 | 0.00 | Example |
| 50 | 1317 | 1.44 | 282 | −0.01 | Example |
| 51 | 1056 | 1.45 | 21 | 0.00 | Comparative Example |
| 52 | 1373 | 1.44 | 338 | −0.01 | Example |
| 53 | 1237 | 1.45 | 202 | 0.00 | Example |

As can be seen from Table 20, also in the case where—in order to allow an RLM alloy powder and an RH fluoride powder to be present on the surface of the sintered R-T-B based magnet—a method of applying a slurry containing them was adopted, $H_{cJ}$ was significantly improved with hardly any lowering of $B_r$ in the sintered R-T-B based magnets according to the production method of the present invention. However, in Sample 44 having more RH fluoride than defined by the mixed mass ratio according to the present invention, and in Sample 51 having less RH fluoride than defined by the mixed mass ratio according to the present invention (i.e., with no RH fluoride being mixed), the $H_{cJ}$ improvement was not comparable to that attained by the present invention.

Experimental Example 10

Sample 57 was obtained in a similar manner to Experimental Example 9, except for using a diffusion agent containing an oxyfluoride and using a powder mixture obtained through mixing with a diffusion auxiliary agent shown in Table 21 according to the mixing ratio shown in Table 21. Magnetic characteristics of Sample 57 thus obtained were measured with a B-H tracer, and variations in $H_{cJ}$ and $B_r$ were determined. The results are shown in Table 22. For comparison, Table 22 also shows a result of Sample 47, which was produced under the same condition with $TbF_3$ being used as the diffusion agent.

TABLE 21

| Sample No. | diffusion auxiliary agent composition (at. ratio) | melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 47 | $Nd_{70}Cu_{30}$ | 520 | $TbF_3$ | 7:3 | 0.07 | Example |
| 57 | $Nd_{70}Cu_{30}$ | 520 | $TbF_3$ + TbOF | 7:3 | 0.07 | Example |

TABLE 22

| Sample No. | $H_{cJ}$ (kA/m) | $B_r$(T) | ⊿$H_{cJ}$ (kA/m) | ⊿Br (T) | |
|---|---|---|---|---|---|
| 47 | 1417 | 1.44 | 382 | −0.01 | Example |
| 57 | 1406 | 1.44 | 371 | −0.01 | Example |

Hereinafter, the diffusion agent containing an oxyfluoride which was used in Sample 57 will be described. For reference's sake, $TbF_3$, which was used in Sample 47 and others, will also be described.

Regarding the diffusion agent powder of Sample 57 and the diffusion agent powder of Sample 47, an oxygen amount and a carbon amount were measured via gas analysis. The diffusion agent powder of Sample 47 is the same diffusion agent powder that was used in other Samples in which $TbF_3$ was used.

The diffusion agent powder of Sample 47 had an oxygen amount of 400 ppm, whereas the diffusion agent powder of Sample 57 had an oxygen amount of 4000 ppm. The carbon amount was less than 100 ppm in both.

By SEM-EDX, a cross-sectional observation and a component analysis for each diffusion agent powder were conducted. Sample 57 was divided into regions with a large oxygen amount and regions with a small oxygen amount. Sample 47 showed no such regions with different oxygen amounts.

The respective results of component analysis of Samples 47 and 57 are shown in Table 23.

TABLE 23

| Sample No. | diffusion agent composition (at. ratio) | position of analysis | Tb (at %) | F (at %) | O (at %) |
|---|---|---|---|---|---|
| 47 | $TbF_3$ | — | 26.9 | 70.1 | 3.0 |
| 57 | $TbF_3$ + TbOF | small oxygen amount | 26.8 | 70.8 | 2.4 |
| | | large oxygen amount | 33.2 | 46.6 | 20.2 |

In the regions of Sample 57 with large oxygen amounts, some Tb oxyfluoride which had been generated in the process of producing $TbF_3$ presumably remained. According to calculations, the oxyfluoride accounted for about 10% by mass ratio.

From the results of Table 22, it can be see that, $H_{cJ}$ was improved in the Sample using an RH fluoride, in which an oxyfluoride had partially remained, to a similar level as was attained in the Sample in which an RH fluoride was used.

Experimental Example 11

A diffusion auxiliary agent was left at room temperature in the atmospheric air for 50 days, thereby preparing a diffusion auxiliary agent with an oxidized surface. Except for this aspect, Sample 58 was produced in a similar manner to Sample 3. Note that the diffusion auxiliary agent having been left for 50 days was discolored black, and the oxygen content, which had been 670 ppm before the leaving, was increased to 4700 ppm.

A sintered R-T-B based magnet matrix was left in an ambient with a relative humidity 90% and a temperature of 60° C. for 100 hours, thus allowing red rust to occur in numerous places on its surface. Except for using such a sintered R-T-B based magnet matrix, Sample 59 was produced in a similar manner to Sample 3. Magnetic characteristics of Samples 58 and 59 thus obtained were measured with a B-H tracer, and variations in $H_{cJ}$ and $B_r$ were determined. The results are shown in Table 24. For comparison, Table 24 also shows the result of Sample 3.

TABLE 24

| Sample No. | $H_{cJ}$ (kA/m) | $B_r$(T) | ⊿$H_{cJ}$ (kA/m) | ⊿Br (T) | |
|---|---|---|---|---|---|
| 3 | 1253 | 1.44 | 218 | −0.01 | Example |
| 58 | 1250 | 1.44 | 215 | −0.01 | Example |
| 59 | 1245 | 1.44 | 210 | −0.01 | Example |

From Table 24, it was found that, the $H_{cJ}$ improvement is hardly affected even if the surface of the diffusion auxiliary agent or the sintered R-T-B based magnet matrix is oxidized.

INDUSTRIAL APPLICABILITY

A method for producing a sintered R-T-B based magnet according to the present invention can provide a sintered R-T-B based magnet whose $H_{cJ}$ is improved with less of a heavy rare-earth element RH.

The invention claimed is:

1. A method for producing a sintered R-T-B based magnet, comprising:

a step of providing a sintered R-T-B based magnet, where R is one or more rare-earth elements, T is one or more transition metal elements, and B is boron or is boron and carbon; and a step of performing a heat treatment at a sintering temperature of the sintered R-T-B based magnet or lower, while a powder of an Nd—Cu alloy consisting of Nd and Cu and a powder of an RH fluoride (where RH is Dy and/or Tb) are present on a surface of the sintered R-T-B based magnet, wherein, an Nd content in the Nd—Cu alloy is 50 at % or more, and a melting point of the Nd—Cu alloy is equal to or less than a temperature of the heat treatment; and the heat treatment is performed while the Nd—Cu alloy powder and the RH fluoride powder are present on the surface of the sintered R-T-B based magnet at a mass ratio of Nd—Cu alloy:RH fluoride=96:4 to 5:5, so that the RH fluoride powder is reduced by the Nd—Cu alloy powder to diffuse an RH element that is contained in the RH fluoride powder into the sintered R-T-B based magnet.

2. The method for producing a sintered R-T-B based magnet of claim 1, wherein, on the surface of the sintered R-T-B based magnet, the RH element that is contained in the powder of the RH fluoride has a mass of 0.03 to 0.35 mg per 1 $mm^2$ of the surface.

3. The method for producing a sintered R-T-B based magnet of claim 1, wherein the Nd—Cu alloy powder and the RH fluoride powder are in a mixed state on the surface of the sintered R-T-B based magnet.

4. The method for producing a sintered R-T-B based magnet of claim 1, wherein substantially no powder of any RH oxide is present on the surface of the sintered R-T-B based magnet.

5. The method for producing a sintered R-T-B based magnet of claim 1, wherein a part of the RH fluoride is an RH oxyfluoride.

* * * * *